US005662057A

United States Patent [19]

Leu

[11] Patent Number: 5,662,057

[45] Date of Patent: Sep. 2, 1997

[54] CONNECTING DEVICE FOR CONNECTING A CLOTH PULLING ARRANGEMENT TO A SEWING MACHINE

[76] Inventor: Shueh Chung Leu, P.O. Box 82-144, Taipei, Taiwan

[21] Appl. No.: 636,353

[22] Filed: Apr. 23, 1996

[51] Int. Cl.[6] ..... D05B 27/10

[52] U.S. Cl. ..... 112/322; 112/259

[58] Field of Search ..... 112/322, 318, 112/258, 259, 168, 2, 303, 320

[56] References Cited

U.S. PATENT DOCUMENTS 4,854,254 8/1989 Hsing ..... 112/322 X 4,996,934 3/1991 Lue ..... 112/259 X

*Primary Examiner*—Peter Nerbun

*Attorney, Agent, or Firm*—Alfred Lei

[57] ABSTRACT

A connecting device for connecting a cloth pulling arrangement to a sewing machine including first connecting member having first, second and third connecting portions, a second connecting member mounted on an arm of a sewing machine, an adjustable frame including a first rail and a second rail which are slidably engaged with the third connecting portion of the first connecting member, a first fixing member for fixedly mounting the first connecting portion of the first connecting member to a back of a housing of the sewing machine using one of existing holes of the housing, a second fixing member for fixedly mounting the first connecting portion of the first connecting member to the back of the housing using another of the existing holes, means for installing a governor to the second connecting portion of the first connecting member, and means for mounting the cloth pulling arrangement and a solenoid actuator means to the second connecting member.

1 Claim, 6 Drawing Sheets

CONNECTING DEVICE FOR CONNECTING A CLOTH PULLING ARRANGEMENT TO A SEWING MACHINE

CROSS-REFERENCE

This application is related to patent application No. 373,897, now granted patent No. 4,966,934.

BACKGROUND OF THE INVENTION

1. Field of the Invention

This invention relates to a connecting device for connecting a cloth pulling arrangement to a sewing machine.

2. Description of the Prior Art

It has been found that a cloth pulling arrangement is used for pulling the cloth in the sewing machine taut to resist formation of wrinkles in cloth during operation of the sewing machine and to maintain the sewn portion flat, neat and beautiful. However, there are more than one hundred sewing machine types in the market and so it is necessary for the manufacturer of the prior art cloth pulling arrangement to produce more than one hundred types of connecting frames for connecting the cloth pulling arrangement to different types of sewing machines. Therefore, the manufacturers of the prior art cloth pulling arrangement have been annoyed by the following problems:

1. It is necessary for the manufacturers of cloth pulling arrangements to warehouse a lot of connecting frames thereby annoying the manufacturers in management, manufacture and installation.

2. The classification and specification of the connecting frames are complicated thereby often causing misunderstanding during communication between the clothes and cloth pulling arrangement manufacturers, and therefore resulting in annoyance.

3. As many holes have to be drilled into the sewing machine for installing the connecting frames, it is difficult for ordinary clothes factories to install the connecting frames by themselves and so it is necessary to request the manufacturer of cloth pulling arrangements to dispatch a technician to install the connecting frames hence causing very much inconvenience.

SUMMARY OF THE INVENTION

This invention relates to a connecting device for connecting a cloth pulling arrangement to a sewing machine.

It is the primary object of the present invention to provide a connecting device for connecting a cloth pulling arrangement which is mounted on a sewing machine by utilizing a first existing connecting hole for installing a lighting lamp on the back of the sewing machine to be removed for installing a locking member and a second existing connecting hole on the back of the sewing machine for installing a hinge to be removed for installing a first connecting member.

It is another object of the present invention to provide a connecting device for connecting a cloth pulling arrangement to a sewing machine of which the cloth pulling roller can be adjusted in position as required.

It is still another object of the present invention to provide a connecting device for connecting a cloth pulling arrangement to a sewing machine without drilling an holes on the sewing machine.

It is still another object of the present invention to provide a connecting device for connecting a cloth pulling arrangement to a sewing machine which is easy to install and dismantle.

It is a further object of the present invention to provide a connecting device for connecting a cloth pulling arrangement to a sewing machine which is facile to operate.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
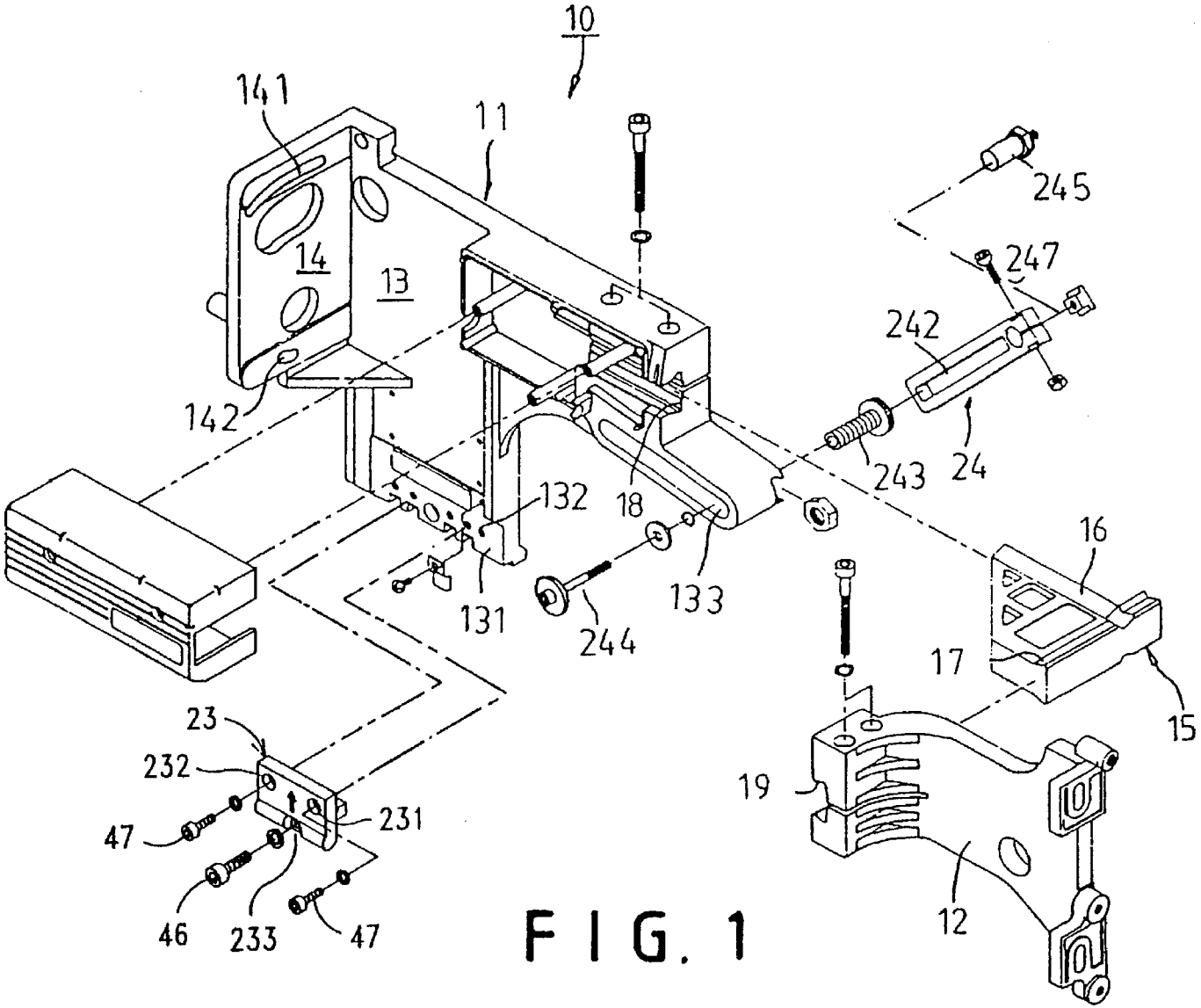
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
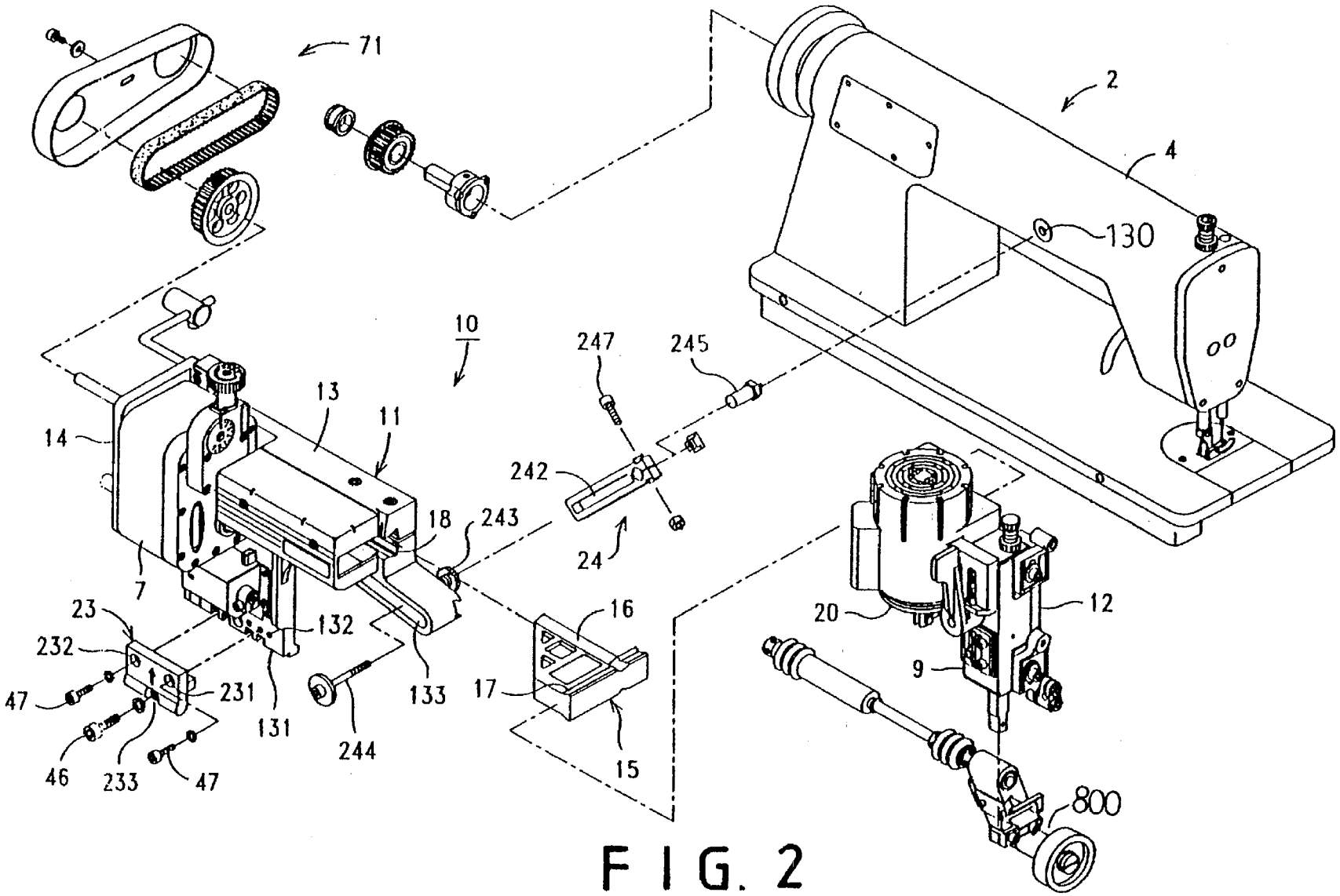
FIG. 2 is an exploded view of the sewing machine provided with the present invention.

With reference to the drawings and in particular to FIGS. 1 and 2 thereof, the connecting device 10 according to the present invention comprises a first connecting member 11, a second connecting member 12, a first fixing member 23, a second fixing member 24 and an adjustable frame 15 and a plurality of bolts.

The first connecting member 11 comprises a first connecting portion 13 and a second connecting portion 14. The first connecting portion 13 has a fixing portion 131 on its bottom which is constituted by a plurality of fixing holes 132. The second connecting portion 14 extends from the left side of the first connecting portion 13 and perpendicular to the first connecting portion 13. There are two fixing grooves 141 and 142 on the second connecting portion 14 for fixing a governor 7 which is driven by a belt assembly 71.

The connecting device 0 further comprises an adjustable frame 15 which includes a first rail 16 and a second rail 17 perpendicular to the first rail 16. The first connecting portion 11 includes a third connecting portion 18 slidably engaged with the first rail 16 and the second rail 17.

The second connecting member 12 has a fourth connecting portion 19 slidably engaged with the second rail 17 and is used for fixing the cloth pulling roller assembly 9 and the solenoid actuator 20 (see FIG. 2).

The first fixing member 23 is provided with two fixing holes 231 and 232 and a locking hole 233 between the two fixing holes 231 and 232.

Figure 3:
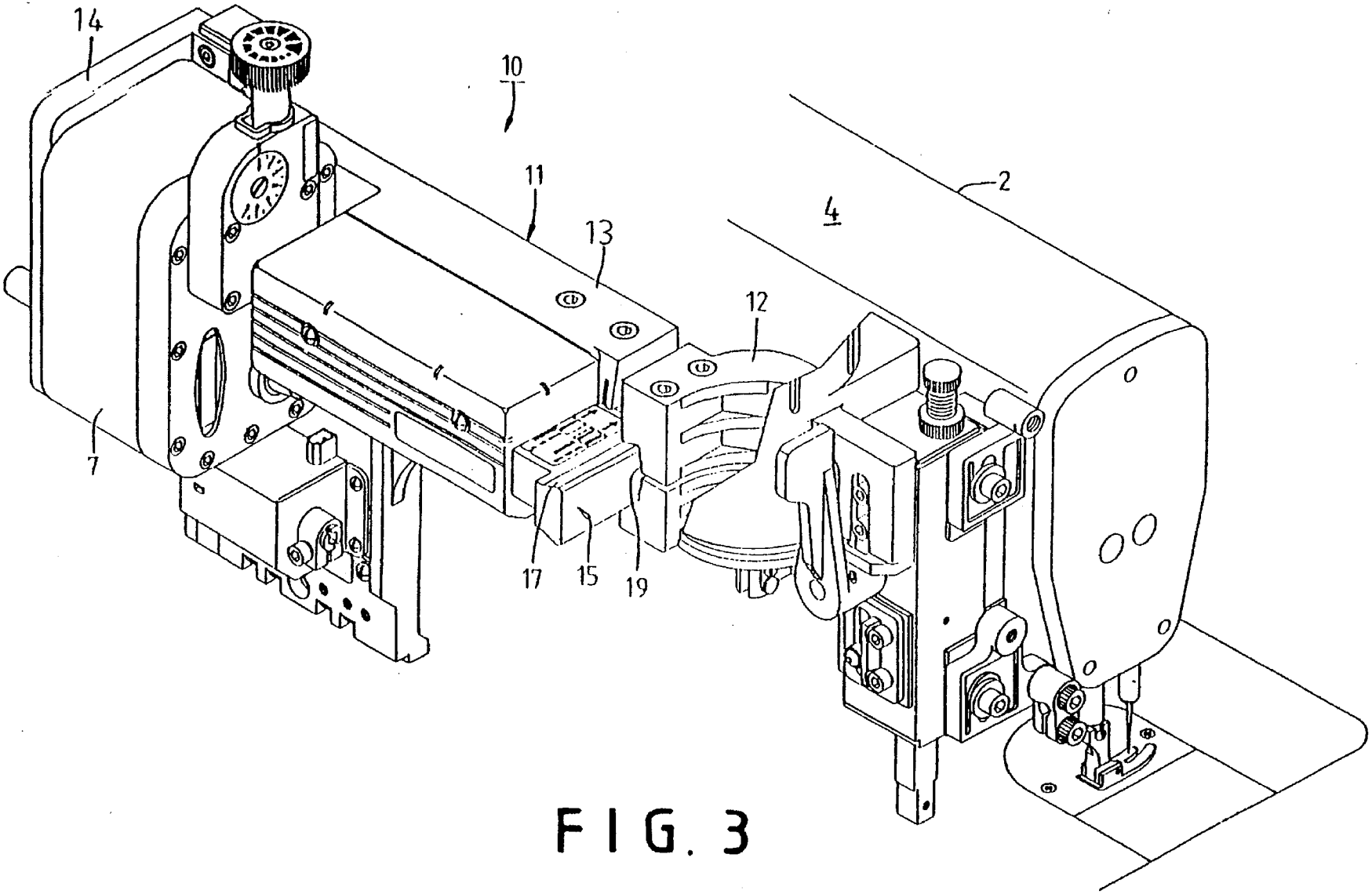
FIG. 3 is a perspective view of the sewing machine provided with the present invention.

In assembly (see FIGS. 2 and 3), a connecting hinge (every sewing machine has a connecting hinge) is dismantled between a work surface 11 of the sewing machine 2 and a wooden table thereby leaving a hole. A screw tap is used for tapping internal threads along the hole. A fixing bolt 46 extends through the locking hole 233 of the first fixing member 23 and is threadedly engaged with the fixing hole 12 of the sewing machine 2 thus fixing the first fixing member 23 on the rear of the sewing machine 2. Two bolts 47 extend through the fixing holes 231 and 232 of the first fixing member 23 for fixing the bottom of the first connecting member 11. The upper and upper right portions of the first connecting member 11 are fixed on the back 4 of a hanging arm of the sewing machine via the second fixing member 24.

Figure 4:
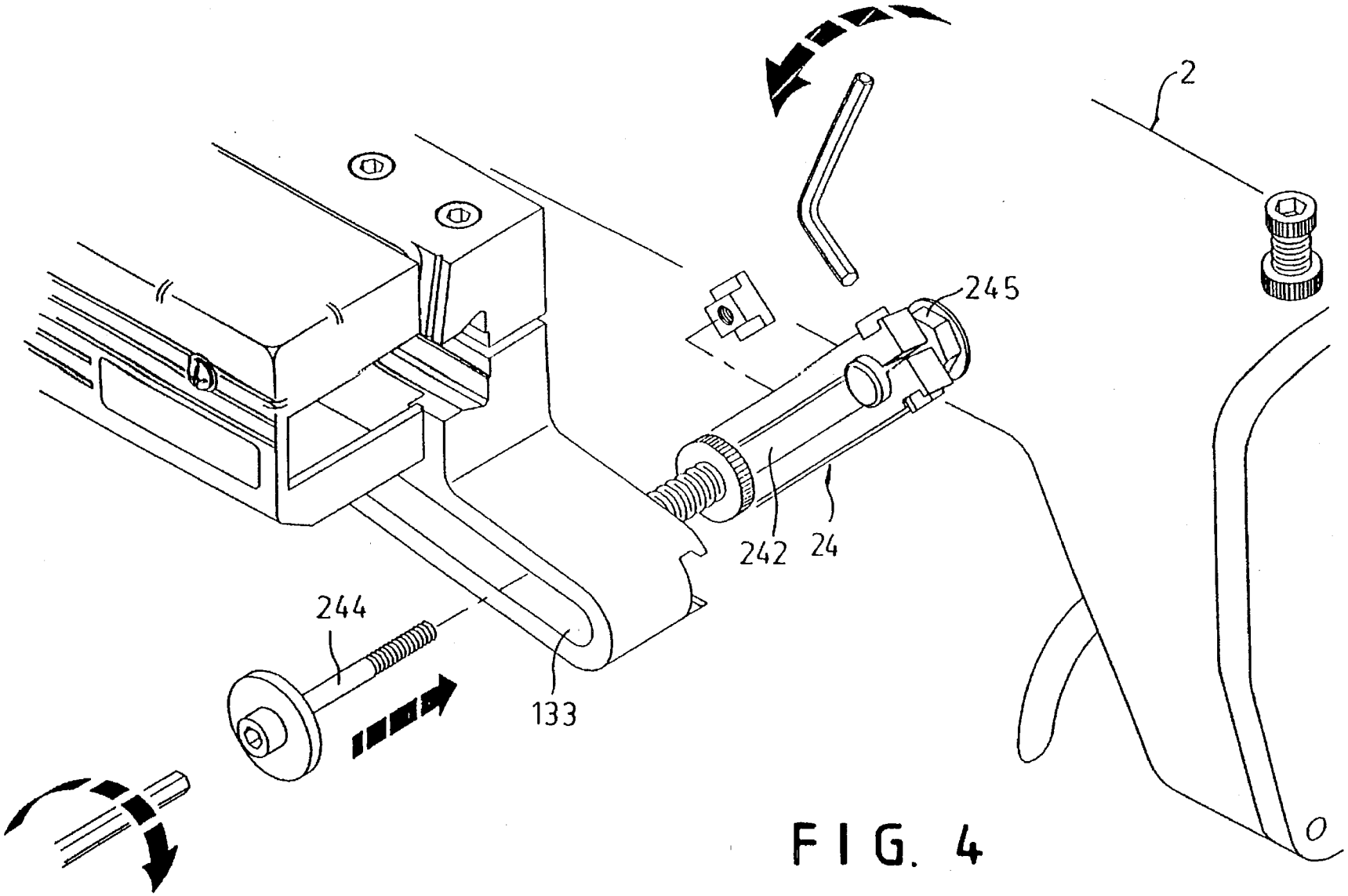
FIG. 4 illustrates how to connect the first connecting member to the existing hole of the sewing machine which is used originally for mounting a lighting lamp.
Figure 5B:
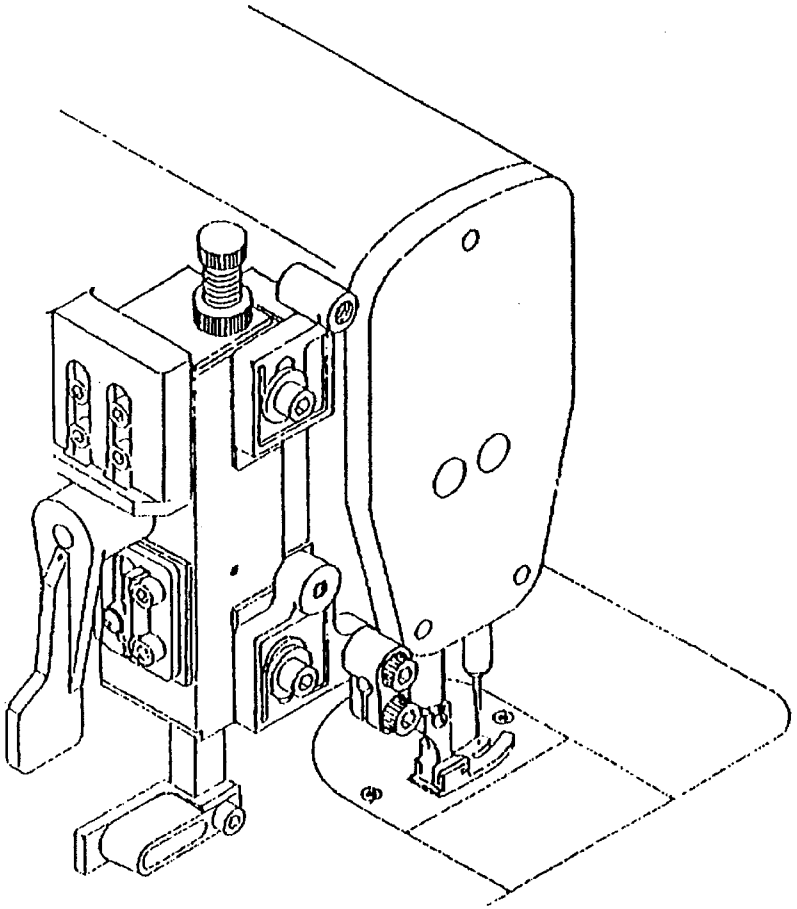
FIG. 5B illustrates the connecting device meeting with no protruded obstacle.
Figure 5A:
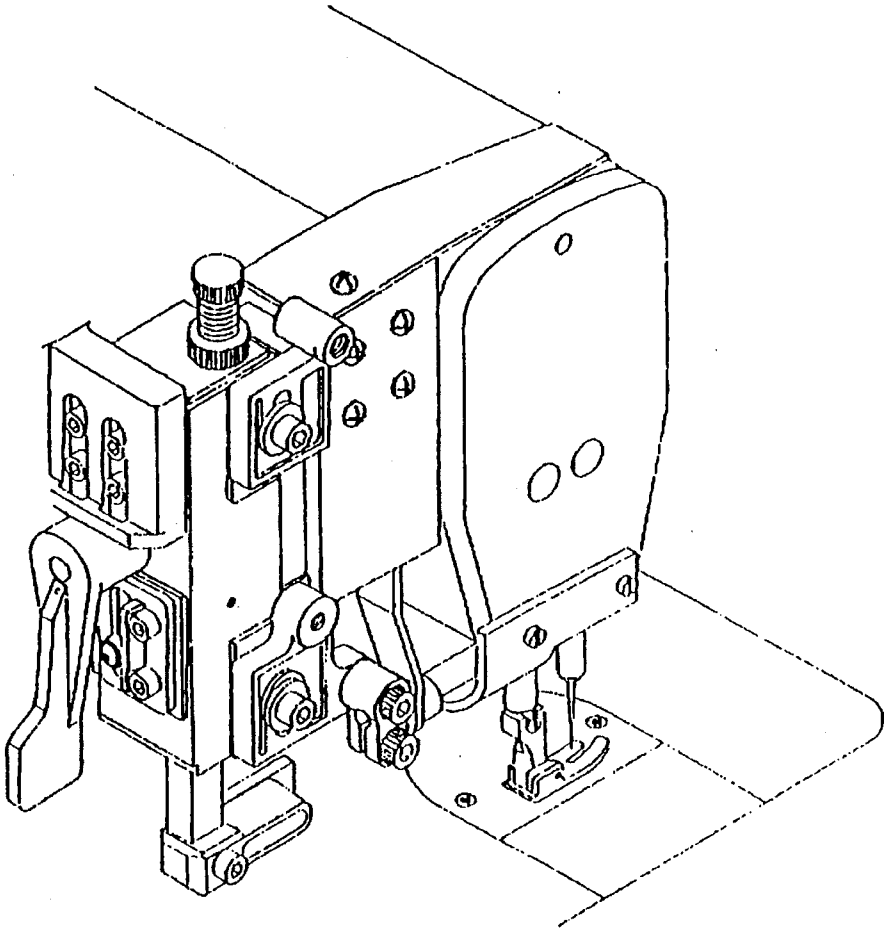
FIG. 5A illustrates the connecting device meeting with a protruded obstacle.

As shown in FIGS. 2 and 4, a connecting block 25 is threadedly engaged with a hole 130 of the sewing machine 2. The hole 130 is used originally to mount a lighting lamp. The second fixing member 24 is mounted into the fixing hole 130 with two bolts 245 and 247 and then adjusted so that the elongated slot 242 is in communication with the elongated slot 133 of the first connecting member 11. Thereafter, a bolt 244 extends through the elongated slot 133 of the first connecting member 11 to engage with a sleeve 243 to engaged with a nut thereby fixing the first connecting member 11 on the back of the sewing machine 2. A roller mechanism 800 is connected with the cloth pulling roller assembly 9 by known means.

Figure 6B:
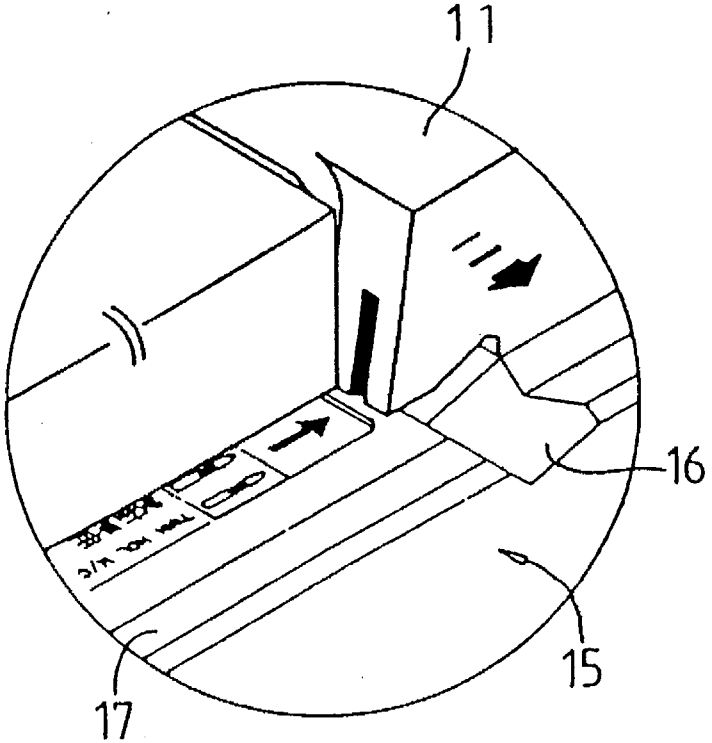
FIG. 6B is an enlarged fragmentary view of FIG. 6A.
Figure 6A:
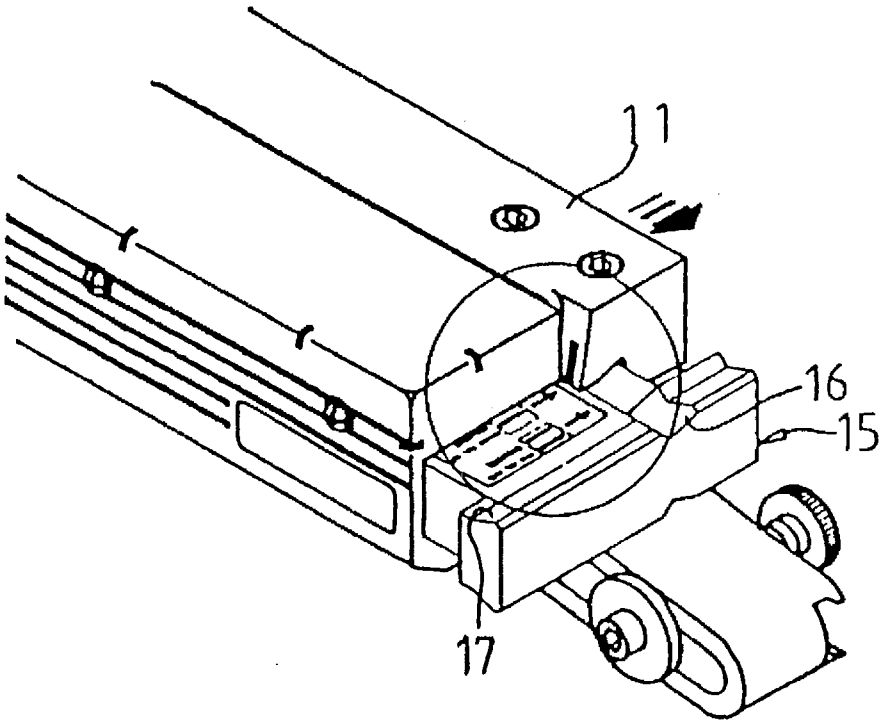
FIG. 6A illustrates how to adjust the position of the first connecting member.

In conclusion, the position of the third connecting member 18 can be adjusted as required (see FIGS. 6A and 6B).

The invention is naturally not limited in an sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A sewing machine and a connecting device for connecting a cloth pulling arrangement to said sewing machine comprising:

a first connecting member having first, second and third connecting portions;

a second connecting member mounted on an arm of said sewing machine;

an adjustable frame including a first rail and a second rail which are slidably engaged with said third connecting portion of said first connecting member;

a first fixing member for fixedly mounting said first connecting portion of said first connecting member to a back of a housing of said sewing machine using one of existing holes of said housing;

a second fixing member for fixedly mounting said first connecting portion of said first connecting member to the back of said housing using another of said existing holes;

means for installing a governor to said second connecting portion of said first connecting member; and means for mounting said cloth pulling arrangement and a solenoid actuator means to said second connecting member.

* * * * *